US009586714B2

(12) United States Patent
Kountotsis

(10) Patent No.: US 9,586,714 B2
(45) Date of Patent: Mar. 7, 2017

(54) DUAL CHAMBER BOTTLE AND METHOD OF MANUFACTURING THE SAME

(76) Inventor: Theodosios Kountotsis, Melville, NY (US)

( * ) Notice: Subject to any disclaimer, the term of this patent is extended or adjusted under 35 U.S.C. 154(b) by 897 days.

(21) Appl. No.: 13/524,433

(22) Filed: Jun. 15, 2012

(65) Prior Publication Data

US 2012/0248055 A1 Oct. 4, 2012

(51) Int. Cl.

| | |
|---|---|
| ***B65D 1/24*** | (2006.01) |
| ***B65D 25/04*** | (2006.01) |
| ***B65D 1/04*** | (2006.01) |
| ***B65D 47/26*** | (2006.01) |

(52) U.S. Cl.

CPC ..... *B65D 1/04* (2013.01); *B65D 47/265* (2013.01); *Y10T 29/49* (2015.01); *Y10T 29/49826* (2015.01)

(58) Field of Classification Search

USPC .... 215/6, 306, 313, 322, 523, 592; 220/249, 220/253, 975, 500, 503, 505, 523, 553, 220/555, 556, 710.5, 717, 754, 813; 222/123, 132, 142.1, 142.2, 142.7, 142.8, 222/142.9, 144.5, 145.1, 145.4, 480, 545, 222/556, 559, 561, 566

See application file for complete search history.

(56) References Cited

U.S. PATENT DOCUMENTS 557,352 A * 3/1896 Bender ..... 215/4
2003/0173364 A1* 9/2003 Eva et al. ..... 220/524

* cited by examiner

*Primary Examiner* — Fenn Mathew
*Assistant Examiner* — Kevin Castillo
(74) *Attorney, Agent, or Firm* — Theodosios Kountotsis

(57) ABSTRACT

A bottle is presented including a body portion having a dividing wall therein; a first chamber for holding a first liquid; a second chamber for holding a second liquid; a removable cap adapted to be operational in an oblique configuration with respect to a base portion of the bottle; and a single slidable orifice configured to travel on a substantially circular track adapted and dimensioned to be flush with a non-movable top surface of the removable cap.

20 Claims, 9 Drawing Sheets

DUAL CHAMBER BOTTLE AND METHOD OF MANUFACTURING THE SAME

CROSS REFERENCE TO RELATED APPLICATION

This application is a continuation of U.S. Pat. No. 8,240,497, filed on Nov. 12, 2008, the entire disclosure of which is incorporated by reference herein.

BACKGROUND

Field of the Related Art

The present disclosure relates to bottles, and more particularly, but not exclusively, to a bottle having dual chambers for separately dispensing liquids via an oblique surface.

Description of the Related Art

Liquid storage containers have been provided in numerous shapes and sizes for various liquid commodities. The most ubiquitous liquid storage containers are presently plastic and provide multiple shapes and sizes with mass production capability and recyclable materials. A popular liquid storage container is a drinking bottle. Typically, most individuals utilize a drinking bottle formed of a molded plastic material. The most common type of molded plastic drinking bottle employs a neck portion supporting a removable cap and a chamber connected to the neck portion. These plastic drinking bottles are reasonably durable, are reusable with most liquid drinks of choice, are economical to make and to purchase, and are easy to use (in that an individual can grip the bottle with one hand and take a drink via the outlet means without spilling the liquid).

In particular, sports bottles have become very popular over the years as molded plastic drinking bottles. Sports bottles are containers which generally have a removable lid, are relatively tall and easy to hold and have a cap or lid positioned at the top portion of the sports bottle. Sports bottles have become quite popular given the increased exercise activity of individuals. Sports bottles are convenient because they do not leak and can be readily carried or placed without fear of spilling the liquid contained therein. To use a sports bottle, one simply places the desired liquid in the sport bottle and closes the lid and/or inserts a straw. Thereafter, whenever it is desired to acquire liquid, one merely opens the lid to allow access to the liquid.

Many individuals who exercise are interested in workouts of extended durations, at various levels of intensity. Thus, many individuals have available or even carry several individual bottles of water or other liquids to replenish body liquids lost from sweating. These individuals may particularly seek to take more than one type of drink while maintaining the same exercise pace and without carrying multiple bottles containing different liquids. Thus, many individuals may desire more than one type of drink to replenish body liquids lost from sweating when engaging in one or more intense workout activities, without inadvertently mixing the liquids.

Furthermore, one of the most critical needs facing individuals engaged in sports is the continuous supply or intake of different liquids (e.g., drinking water, sports drinks, energy drinks, protein shakes, etc.) while they exercise. During extended exercise activities, individuals face serious dehydration problems and the loss of competitive capability unless they continuously replenish the fluids lost during such exercise activities. However, the human body requires many different types of vitamins or minerals that cannot all be found in one type of liquid. As a result, once again, individuals may desire more than one type of drink to replenish body liquids lost from sweating when engaging in one or more intense workout activities, without inadvertently mixing the liquids, in order to replenish several types of vitamins and minerals.

Moreover, sports enthusiasts are typically becoming more aware of the benefits of combining the use of electrolyte replacing sports drinks and/or water and/or protein shakes for ultimate performance enhancement and refreshment. Additionally, even children/teenagers often desire to consume more than a single flavor of soft drink or juices or any other type of desirable liquid. Also, adults who consume caffeinated energy drinks frequently purchase bottled water to compliment the energy drink in order to quench their thirst. In other words, such individuals must carry two or more bottles to quench their thirst. Thus, there is a need to provide a bottle that is capable of dispensing more than one type of liquid separately, without inadvertently mixing the liquids.

Consequently, traditional sports bottles present a limitation in that they do not allow an individual to enjoy a plurality of different liquid drinks separately from each other, without mixing the liquids, and at the same time period. Presently, many dual chamber bottle systems lack the ability to effectively provide two or more liquids to an individual without mixing the liquid contents. In addition, another limitation is the fact that an individual must carry a plurality of bottles, each of the plurality of bottles containing different liquids. In addition, many individuals have a desire to combine the intake of liquids with the intake of solid supplements, such as energy bars, energy gels, vitamin supplements, etc.

Traditional dual chamber bottles do not provide for effective means of purposely separating two or more liquids or a liquid and a non-liquid desired to be consumed by an individual. In other words, traditional dual chamber bottles allow for inadvertent mixing of liquids, even though the individual desires to consume only one drink at a time. Thus, despite other practitioners' efforts to provide improved systems, there remains nonetheless a continuing need in the art for an improved liquid supply apparatus for use by individuals, such as, but not limited to, individuals engaged in sports or exercise activities.

The present disclosure is intended to overcome the drawbacks of conventional dual chamber bottle systems by exploiting bottle morphology in order to successfully separate liquids without allowing inadvertent mixing of liquids. It is desirable to provide a single container having multiple elements for storage of different commodities and a means for selecting between them during consumption. It is further desirable that such a container be easily manufactured, filled, and assembled. In particular, the present disclosure relates to a bottle for separately providing two or more liquids to an individual, without mixing the liquids, via an oblique surface. The present disclosure further relates to a method of manufacturing a dual chamber bottle having an oblique top surface that prevents the inadvertent mixture of liquids.

SUMMARY

The present disclosure provides a bottle including a body portion having a dividing wall extending from a base portion to a connection region; a first chamber for holding a first liquid; a second chamber for holding a second liquid; and a removable oblique cap; wherein a height of the dividing wall is less than an overall height of the body portion and the connection region is configured to be a maximum height of the dividing wall.

The present disclosure also provides a bottle including a body portion having a dividing wall extending from a base portion to a connection region; a first chamber for holding a first liquid; a second chamber for holding a second liquid; and a removable and rotatable oblique cap having a fixed orifice; wherein a height of the dividing wall is less than an overall height of the body portion and the connection region is configured to be a maximum height of the dividing wall.

The present disclosure also provides a bottle including a body portion having a dividing wall extending from a base portion to a connection region; a first chamber for holding a liquid, the first chamber configured to connect to an orifice; a second chamber for storing one or more non-liquid elements, the second chamber configured to connect to an opening; and wherein a height of the dividing wall is less than an overall height of the body portion and the connection region is configured to be a maximum height of the dividing wall.

The present disclosure also provides a method for manufacturing a battle including the steps of forming a body portion having a dividing wall extending from a base portion to a connection region; forming a first chamber for holding a first liquid; forming a second chamber for holding a second liquid; and forming a removable oblique cap with a slidable orifice; wherein a height of the dividing wall is less than an overall height of the body portion and the connection region is configured to be a maximum height of the dividing wall.

The present disclosure also provides a method for manufacturing a bottle, the method including the steps of forming a body portion having a dividing wall extending from a base portion to a connection region; forming a first chamber for holding a first liquid; forming a second chamber for holding a second liquid; and forming a removable and rotatable oblique cap having a fixed orifice; wherein a height of the dividing wall is less than an overall height of the body portion and the connection region is configured to be a maximum height of the dividing wall.

BRIEF DESCRIPTION OF THE DRAWINGS

Various embodiments of the present disclosure will be described herein below with reference to the figures wherein.

Figure 1:
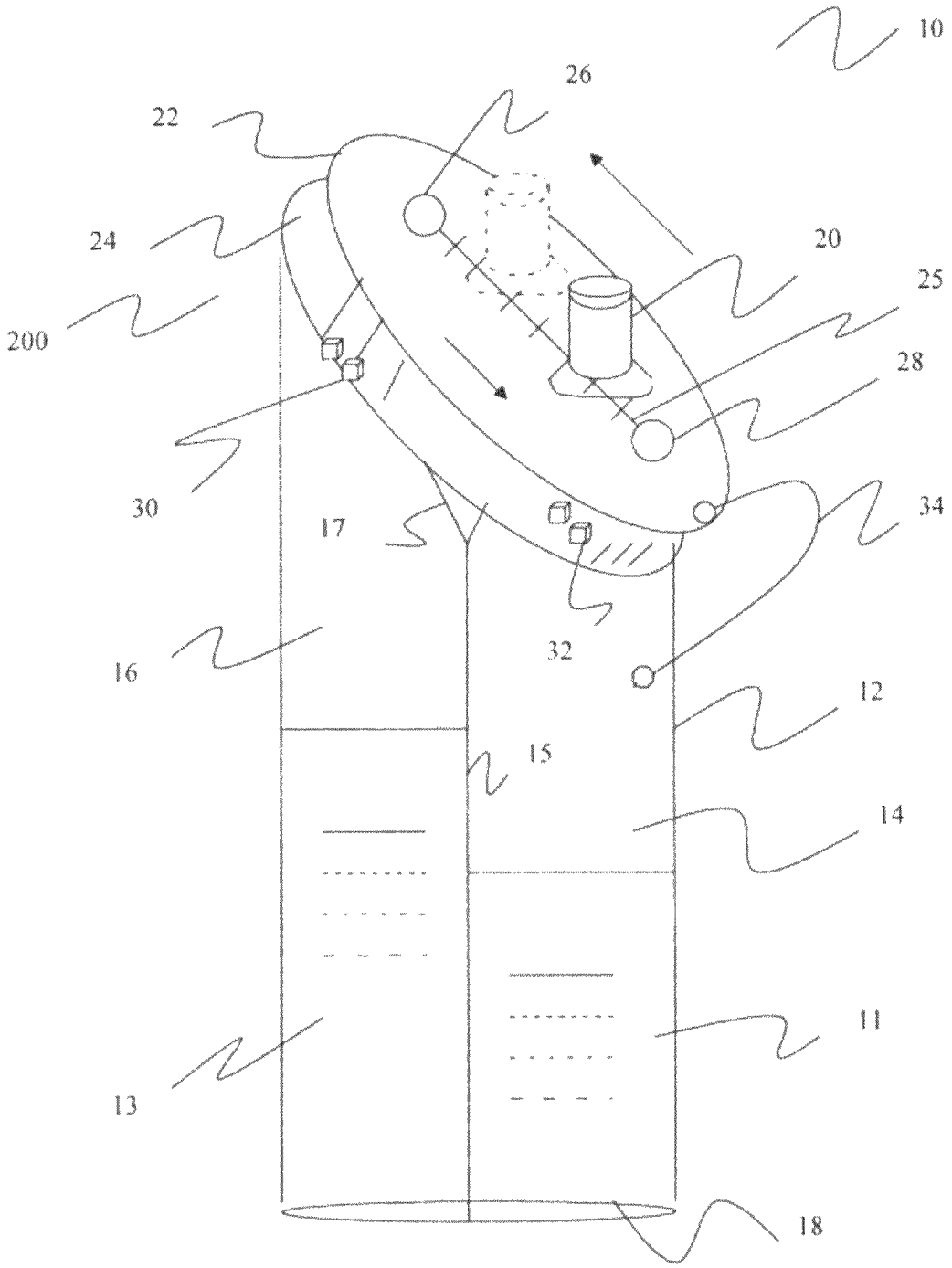
FIG. 1 is a perspective view of a dual-chambered drinking bottle having a linearly slidable orifice, in accordance with the present disclosure.

Further scope of applicability of the present disclosure will become apparent from the detailed description given hereinafter. However, it should be understood that the detailed description and specific examples, while indicating preferred embodiments of the present disclosure, are given by way of illustration only, since various changes and modifications within the spirit and scope of the invention will become apparent to those skilled in the art from this detailed description.

DETAILED DESCRIPTION

Unless otherwise indicated, all numbers expressing quantities and conditions, and so forth used in the specification and claims are to be understood as being modified in all instances by the term "about." In this application, the use of the singular includes the plural unless specifically stated otherwise, in this application, the use of "or" means "and/or" unless stated otherwise. Furthermore, the use of the term "including," as well as other forms, such as "includes" and "included," is not limiting. Also, terms such as "element" or "component" encompass both elements and components comprising one unit and elements and components that comprise more than one subunit unless specifically stated otherwise. The term "coupled to" means to be attached or connect to directly or indirectly or to be incorporated within.

As used in this description and in the appended claims, the word "container" does not necessarily refer to a rigid or a somewhat deformable structure, such as a "battle," "bottle portion," or "bottle half" for containing liquid. Rather, the word "container" in the present disclosure and in the appended claims can also mean a "box," "packet," "bag," "portion of a bag," "pocket of a bag," or any such deformable structure for containing liquid.

As used in the present disclosure and in the appended claims, the word "channel" does not necessarily refer to a tunnel, straw, tube, bore, or other such elongated structure for conveying liquid. Rather, the word "channel" in this description and in the appended claims can also refer to an "opening," or any such structure for conveying liquid. As used in the present disclosure and in the appended claims, the word "chamber" can refer to a cup having an open mouth for drinking or can refer to an enclosed compartment having an opening or orifice for drinking.

The present disclosure proposes to provide an improved sports bottle. It is a more particular object of the present disclosure to provide an improved sports bottle which is quickly and easily refillable with two different liquids. It is a still more particular object of the present disclosure to provide an improved sports bottle which is quickly and easily refillable and which effectively prevents the mixture of liquids, via an oblique top surface, when dispensed from the bottle by a user.

The present disclosure proposes to provide dual compartment pouches/chambers/channels suitable for selectively dispensing two different fluids (e.g., different beverages)

from the same container, the container having an oblique top surface. Such selective dispensing requires a chamber design that allows for manipulation of the compartments individually. This allows the consumer to selectively dispense and consume fluids separately, without the possibility of inadvertently mixing the liquids. The present disclosure also proposes a method for manufacturing a bottle having dual chambers and an oblique top surface that prevents the inadvertent mixing of liquids.

Reference will now be made in detail to embodiments of the present disclosure. While certain embodiments of the present disclosure will be described, it will be understood that it is not intended to limit the embodiments of the present disclosure to those described embodiments. To the contrary, reference to embodiments of the present disclosure is intended to cover alternatives, modifications, and equivalents as may be included within the spirit and scope of the embodiments of the present disclosure as defined by the appended claims.

Embodiments will be described below while referencing the accompanying figures. The accompanying figures are merely examples and are not intended to limit the scope of the present disclosure.

With reference to FIG. 1, there is presented a perspective view of a dual-chambered drinking bottle having a linearly slidable orifice, in accordance with the present disclosure. The dual chamber bottle 10 includes a body or cylindrical enclosure 12, a first chamber 14, a second chamber 16, a base portion 18, an orifice 20, a top portion 22, an annular skirt 24, a first connecting portion 26, a second connecting portion 28, a first latching mechanism 30, a second latching mechanism 32, and a lid strap 34. The bottle 10 further includes a first liquid 11, a second liquid 13, a dividing wall 15, a gap portion 17, and a linear track 25.

Dual chamber bottle 10 includes a body 12 that is preferably formed of a hollow molded plastic material that defines two substantially cylindrical liquid chambers 14, 16 and has a base portion 18. The bottle 10 includes a first chamber 14 for holding a first liquid 11 and a second chamber 16 for holding a second liquid 13, where the first liquid 11 is preferably different than the second liquid 13. It will be apparent to those skilled in the art that the diameters and/or heights of the first chamber 14 and the second chamber 16 and the body 12 may be selected in accordance with design preferences.

The dividing wall 15 extends vertically from the base portion 18, extending through the body 12 and ending at the gap portion 17 (explained below) forming two ridges (e.g., a first ridge 308 and a second ridge 310, described below with reference to FIG. 1A). The dividing wall 15 provides a means for separating the first chamber 14 from the second chamber 16. Applying pressure to one side of the body 12 allows the first liquid 11 of the first chamber 14 to be forced out of the compartment and into the mouth of a user through the orifice 20. The dividing wall 15 prevents the pressure exerted on the first chamber 14 to be transferred to the second chamber 16, thus allowing the user to selectively dispense the contents/liquids of each individual chamber/container/compartment into the mouth of a user via a channel (e.g., first orifice 28 and/or second orifice 34).

As described, the top portion 22 may terminate via the annular skirt 24 to an orifice 20. However, any type of channel may be used, as contemplated by one skilled in the art. For example, each orifice may be replaced by an elongated, substantially cylindrical straw. The straw may be formed of a relatively rigid tubular plastic material or the like.

The top portion 22 is preferably an oblique surface that can have an oblique cap 200 attached to it. The removable oblique cap 200 can include the linearly slidable orifice 20 for separately providing access to the first liquid 11 of the first chamber 14 and the second liquid 13 of the second chamber 16. The top portion 22 may be at a 30 degree angle with respect to the base portion 18. The top portion 22 may be at a 45 degree angle with respect to the base portion 18. The top portion 12 may be at any angle between 0 and 90 degrees with respect to the base portion 18.

The gap portion 17 provides for the effective separation of the first liquid 11 contained in the first chamber 14 from the second liquid 13 contained in the second chamber 16. It is envisioned that the gap portion 17 may be of any reasonable and/or suitable vertical or horizontal length and may be adapted to conform to the height of the first chamber 14 and/or the second chamber 16.

The gap portion 17 prevents the fluid communication between the first chamber 14 and the second chamber 16. The gap portion 17 allows for (i) fluid communication between the first chamber 14 and the orifice 20 and (ii) fluid communication between the second chamber 16 and the orifice 20.

As a result of the gap portion 17, the upper portion of the first chamber 14 has a smaller width than the lower portion of the first chamber 14. In addition, as a result of the gap portion 17, the upper portion of the second chamber 16 has a smaller width than the lower portion of the second chamber 16. The gap portion 17 allows for the height of the dividing wall 15 to be less than the overall height of the body 12. Also, the connecting point of the first ridge 308 and the second ridge 310 (as shown in FIG. 1A) is configured to be a maximum height of the dividing wall 15.

It is envisioned that the top portion 22 (the rim of the body 12) may wholly extend around the gap portion 17 or may extend partially around the gap portion 17. In other words, the outer perimeter of the gap portion 17 may have an outer wall enclosing the gap portion 17. The top portion 22 may extend wholly around the gap portion 17, the first chamber 14, and the second chamber 16 in order to better secure the cap 200.

The orifice 20 may slidably move between the first connecting position 26 and the second connecting position 28 by means of or via the slidable linear track 25. The slidable linear track 25 ensures that the orifice 20 moves in a predetermined or pre-designated path along the surface of the top portion 22. The slidable function allows the user of the bottle 10 to readily switch between the first chamber 14 and the second chamber 16 to selectively access either liquid 11 or liquid 13. The arrows indicate that the orifice 20 can move in a horizontal direction. However, it is contemplated that the path may not be a linear path. The path may be a circular path (as described in FIG. 2) or a zigzag path or any other type of path that may be contemplated for moving the orifice 20 over the top portion 22. The linearly slidable orifice 20 locks in a first connecting position 26 for permitting access to the second liquid 13 of the second chamber 16. The linearly slidable orifice 20 locks in a second connecting position 28 for permitting access to the first liquid 11 of the first chamber 14. The orifice 20 may be at a 30 degree angle with respect to the base portion 18. The orifice 20 may be at a 45 degree angle with respect to the base portion 18. The orifice 20 may be at any angle between 0 and 90 degrees with respect to the base portion 18.

Additionally, the annular skirt 24 may include one or more sets of first latching mechanisms 30 and/or one or more sets of second latching mechanisms 32. These latching mechanisms 30, 32 allow the cap 200 to be fixedly secured to the body 12 of the bottle 10 via a first orientation recess (not shown) and a second orientation recess (not shown) located on the body 12. The latching mechanisms 30, 32 may be spaced out as single units or may be spaced out as sets of two, three, or more. Any number of latching mechanisms may be employed to secure the cap 200 to the body 12. The latching mechanisms and the orientation recesses may be any shape or size contemplated by one skilled in the art.

In operation, the user of the dual chamber bottle 10 can conveniently draw a liquid from the bottle 10 through the orifice 20 while maintaining effective separation of the liquids 11 and 13. In operation, the orifice 20 would be placed in the mouth of a user, who would squeeze the bottle 10 to eject the first liquid 11 from the first chamber 14. Alternately, the orifice 20 would be placed in the mouth of a user, who would squeeze the bottle 10 to eject the second liquid 13 from the second chamber 16. In operation, the gap portion 17 would separate the upper portions of each chamber 14, 16 in order to prevent the inadvertent mixture of liquids. The separation of the first bottle neck (rim or first opening 304, see FIG. 1A) from the second bottle neck (rim or second opening 306, see FIG. 1A) via a gap portion 17 that may vary between a few millimeters to 1-2 inches, via the first ridge 308 and the second ridge 310, enables a user to drink two separate liquids, without mixing the liquids.

Optionally, one or more bottle neck portions may be connected to the body 12 by means of one or more lid straps (e.g., lid strap 34) extending between the one or more bottle neck portions and the body 12. The one or more lid straps may provide for a permanent connection between the bottle neck portions and the body 12 so that the components remain connected to each other at all times.

Moreover, the first chamber 14 may have a different volumetric size than the second chamber 16. Furthermore, the first chamber 14 may have a different height than the second chamber 16. The widths, heights, and volumetric sizes of the first chamber 14 and the second chamber 16 may be adjusted according to design preferences and desired applications.

It will be apparent to those skilled in the art that this separation of liquids via the gap portion 17 offers a substantial advantage by providing the capability to drink more than one liquid without inadvertently mixing the liquids 11, 13.

Figure 1A:
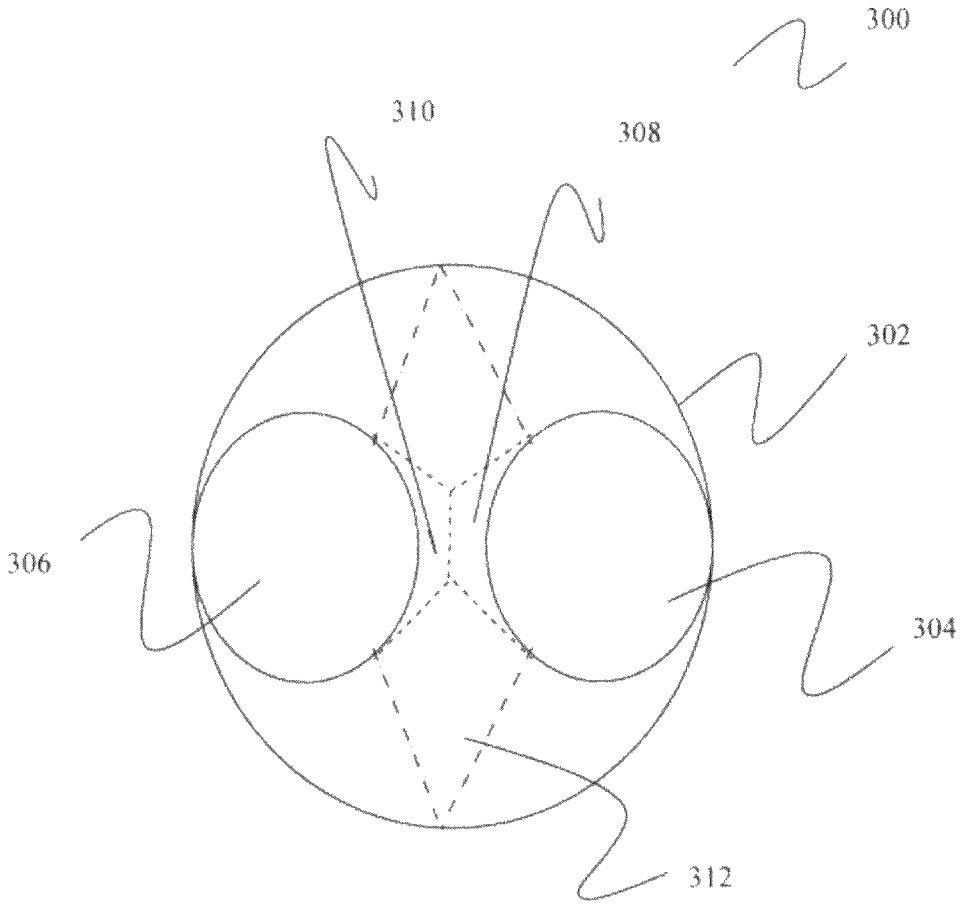
FIG. 1A is a top view of the dual-chambered drinking bottle having the linearly slidable orifice of FIG. 1, in accordance with the present disclosure.

With reference to FIG. 1A, there is presented a top view of the dual-chambered drinking bottle having the linearly slidable orifice of FIG. 1, in accordance with the present disclosure. The top view 300 of the dual chamber bottle 10 includes a top surface 302, a first opening 304, a second opening 306, a first ridge 308, a second ridge 310, and a gap portion 312.

FIG. 1A illustrates how the gap portion 312 separates the first opening 304 from the second opening 306 by providing for a first ridge 308 and a second ridge 310. The connecting point of the first ridge 308 and the second ridge 310 is the upper portion of the dividing wall 15. The separation of the upper portions of the chambers 14, 16 effectively provides for the separation of the liquids 11, 13 when desired to be separately accessed by a user of the bottle 10. The first bottle opening 304 (the rim of the upper portion of the first chamber 14) and the second bottle opening 306 (the rim of the upper portion of the second chamber 16) are prevented from coming into contact with each other, thus forming a gap portion 312 to effectively separate the liquids 11, 13 during the storing and dispensing processes. The gap portion 312 of FIG. 2 is the same gap portion 17 depicted in FIG. 1.

Figure 2:
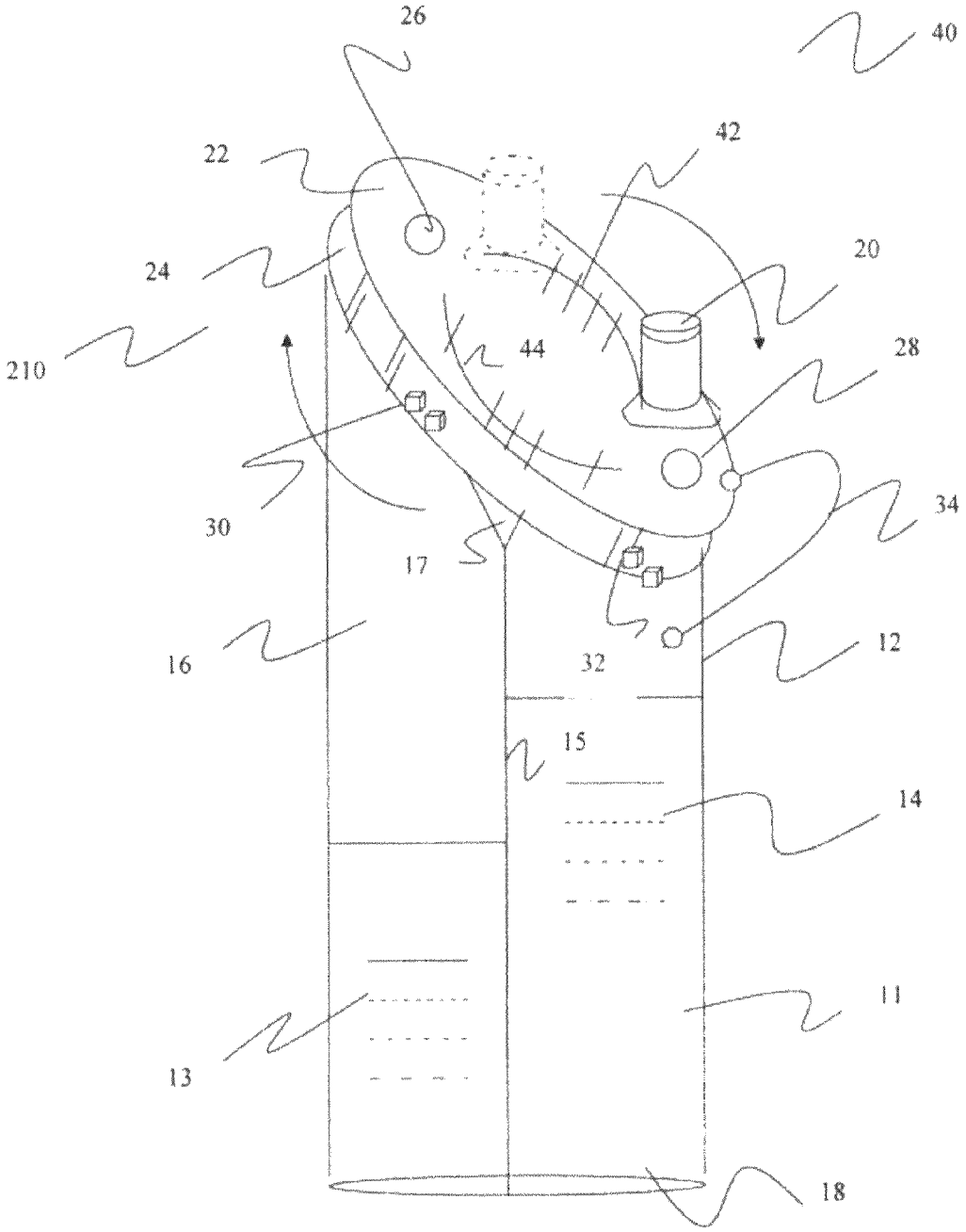
FIG. 2 is a perspective view of a dual-chambered drinking bottle having a rotatably slidable orifice, in accordance with the present disclosure.

With reference to FIG. 2, there is presented a dual-chambered drinking bottle having a rotatably slidable orifice, in accordance with the present disclosure, in accordance with the present disclosure. The bottle 40 includes a first circular slidable track 42 and a second circular slidable track 44. Additionally, the dual chamber bottle 40 includes similar elements to FIG. 1. These similar elements include a body or cylindrical enclosure 12, a first chamber 14, a second chamber 16, a base portion 18, an orifice 20, a top portion 22, an annular skirt 24, a first connecting portion 26, a second connecting portion 28, a first latching mechanism 30, a second latching mechanism 32, a lid strap 34, a first liquid 11, a second liquid 13, a dividing wall 15, and a gap portion 17.

Dual chamber bottle 40 includes a body 12 that is preferably formed of a hollow molded plastic material that defines two substantially cylindrical liquid chambers 14, 16 and has a base portion 18. The bottle 40 includes a first chamber 14 for holding a first liquid 11 and a second chamber 16 for holding a second liquid 13, where the first liquid 11 is preferably different than the second liquid 13. It will be apparent to those skilled in the art that the diameters of the first chamber 14 and the second chamber 16 may be selected in accordance with design preferences.

The dividing wall 15 extends vertically from the base portion 18, extending through the body 12 and ending at the gap portion 17 (explained above with reference to FIG. 1) forming two ridges (e.g., a first ridge 308 and a second ridge 310, described above with reference to FIG. 1A). The dividing wall 15 provides a means for separating the first chamber 14 from the second chamber 16. Applying pressure to one side of the body 12 allows the first liquid 11 of the first chamber 14 to be forced out of the compartment and into the mouth of a user through the orifice 20. The dividing wall 15 prevents the pressure exerted on the first chamber 14 to be transferred to the second chamber 16, thus allowing the user to selectively dispense the contents/liquids of each individual chamber/container/compartment into the mouth of a user via a channel (e.g., orifice 20).

As described, the top portion 22 may terminate via the annular skirt 24 to an orifice 20. However, any type of channel may be used, as contemplated by one skilled in the art. For example, each orifice may be replaced by an elongated, substantially cylindrical straw. The straw may be formed of a relatively rigid tubular plastic material or the like.

The top portion 22 is preferably an oblique surface that can have an oblique cap 210 attached to it. The removable oblique cap 210 can include the circular slidable orifice 20 for separately providing access to the first liquid 11 of the first chamber 14 and the second liquid 13 of the second chamber 16. The top portion 22 may be at a 30 degree angle with respect to the base portion 18. The top portion 22 may be at a 45 degree angle with respect to the base portion 18. The top portion 22 may be at any angle between 0 and 90 degrees with respect to the base portion 18.

The orifice 20 may slidably and circularly move between the first connecting position 26 and the second connecting position 28 by means of or via the first circular slidable track 42 and the second circular slidable track 44. The circular slidable tracks 42, 44 ensure that the orifice 20 moves in a predetermined or pre-designated path along the surface of the top portion 22. The slidable function allows the user of the bottle 40 to readily switch between the first chamber 14 and the second chamber 16 to selectively access either liquid 11 or liquid 13. The arrows indicate that the orifice 20 can move in a circular direction. However, it is contemplated that the path may not be a circular path. The path may be a linear path (as described in FIG. 1) or a zigzag path or any other type of path that may be contemplated for moving the orifice 20 over the top portion 22. The slidable orifice 20 locks in a first connecting position 26 for permitting access to the second liquid 13 of the second chamber 16. The slidable orifice 20 locks in a second connecting position 28 for permitting access to the first liquid 11 of the first chamber 14. The orifice 20 may be at a 30 degree angle with respect to the base portion 18. The orifice 20 may be at a 45 degree angle with respect to the base portion 18. The orifice 20 may be at any angle between 0 and 90 degrees with respect to the base portion 18.

Additionally, the annular skirt 24 may include one or more sets of first latching mechanisms 30 and/or one or more sets of second latching mechanisms 32. These latching mechanisms 30, 32 allow the cap 210 to be fixedly secured to the body 12 of the bottle 40 via a first orientation recess (not shown) and a second orientation recess (not shown) located on the body 12. The latching mechanisms 30, 32 may be spaced out as single units or may be spaced out as sets of two, three, or more. Any number of latching mechanisms may be employed to secure the cap 210 to the body 12. The latching mechanisms and the orientation recesses may be any shape or size contemplated by one skilled in the art.

Optionally, one or more bottle neck portions may be connected to the body 12 by means of one or more lid straps (e.g., lid strap 34) extending between the one or more bottle neck portions and the body 12. The one or more lid straps may provide for a permanent connection between the bottle neck portions and the body 12 so that the components remain connected to each other at all times.

Moreover, the first chamber 14 may have a different volumetric size than the second chamber 16. Furthermore, the first chamber 14 may have a different height than the second chamber 16. The widths, heights, and volumetric sizes of the first chamber 14 and the second chamber 16 may be adjusted according to design preferences and desired applications.

It will be apparent to those skilled in the art that this separation of liquids via the gap portion 17 offers a substantial advantage by providing the capability to drink more than one liquid without inadvertently mixing the liquids 11, 13. It is envisioned that the top portion 22 (the rim of the body 12) may wholly extend around the gap portion 17 or may extend partially around the gap portion 17. In other words, the outer perimeter of the gap portion 17 may have an outer wall enclosing the gap portion 17. The top portion 22 may extend wholly around the gap portion 17, the first chamber 14, and the second chamber 16 in order to better secure the cap 210.

Figure 3:
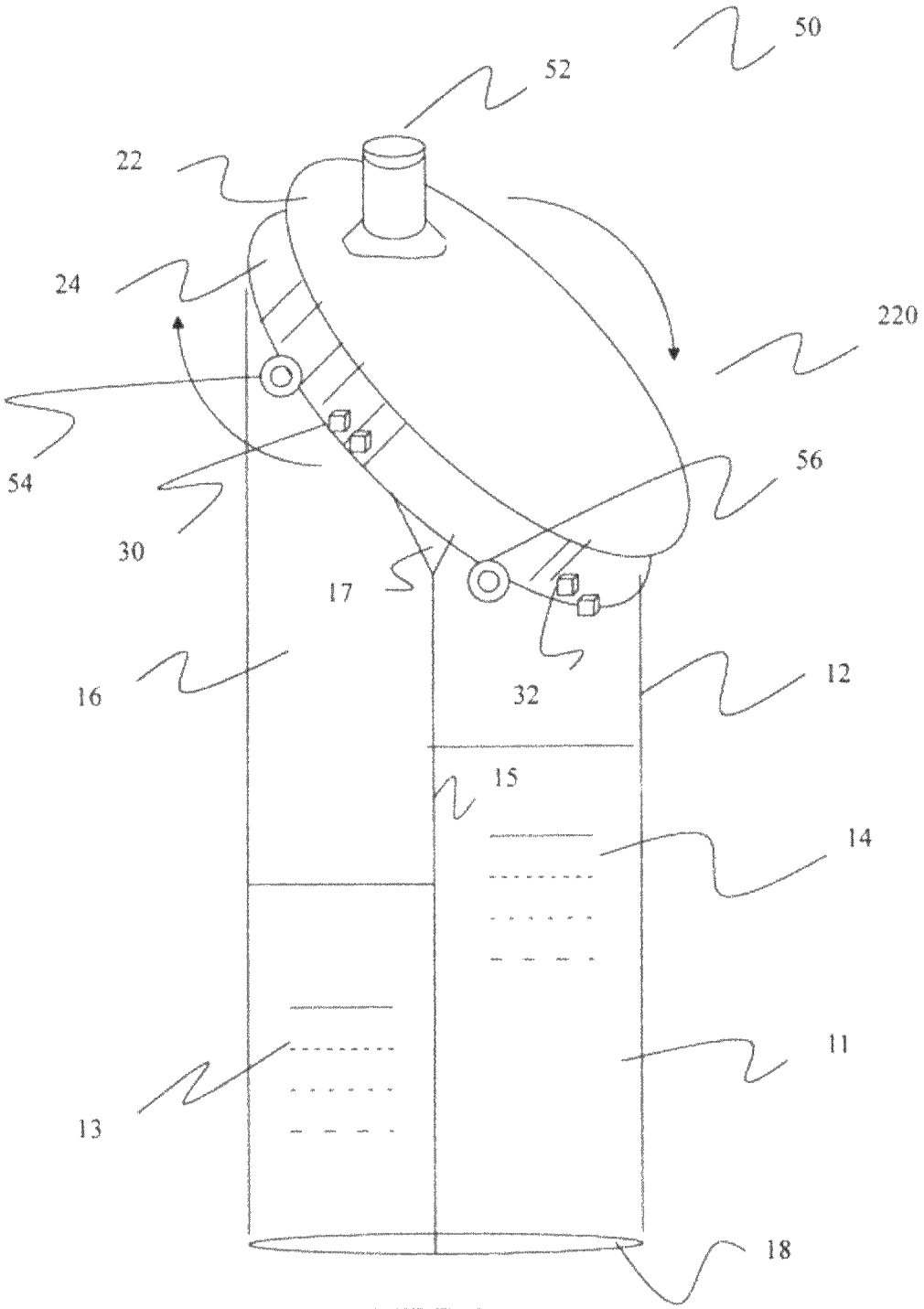
FIG. 3 is a perspective view of a dual-chambered drinking bottle having a rotatable cap with a fixed orifice, in accordance with the present disclosure.

With reference to FIG. 3, there is presented a perspective view of a dual-chambered drinking bottle having a rotatable cap with a fixed orifice, in accordance with the present disclosure. The bottle 50 includes an orifice 52, a first connection position 54, and a second connection position 56. Additionally, the dual chamber bottle 50 includes similar elements to FIG. 1. These similar elements include a body or cylindrical enclosure 12, a first chamber 14, a second chamber 16, a base portion 18, a top portion 22, an annular skirt 24, a first latching mechanism 30, a second latching mechanism 32, a first liquid 11, a second liquid 13, a dividing wall 15, and a gap portion 17.

In this second embodiment of the present disclosure, in contrast to FIGS. 1 and 2, the orifice 52 is fixed on the cap 220. In FIGS. 1 and 2, the orifice 20 was movable between a first connecting position 26 and a second connecting position 28 and the caps 200, 210 were fixed on the body 12. In contrast, in FIG. 3, the orifice 52 is fixed and the cap 220 is movable or rotatable. The movable and rotatable cap 220 can be affixed in two positions, where there is a first connection position 54 and a second connection position 56. The first connection position 54 allows the cap 220 to be affixed in a position where the user can access the second liquid 13 of the second chamber 16. The second connection position 56 allows the cap 220 to be affixed in a position where the user can access the first liquid 11 of the first chamber 14.

In operation, the user of the dual chamber bottle 50 can conveniently draw a liquid from the bottle 50 through either the orifice 52 while maintaining effective separation of the liquids 11 and 13. In operation, the orifice 52 would be placed in the mouth of a user, who would squeeze the bottle 50 to eject the first liquid 11 from the first chamber 14 by rotating the cap 220. Alternately, the orifice 52 would be placed in the mouth of a user, who would squeeze the bottle 50 to eject the second liquid 13 from the second chamber 16 by rotating the cap 220. In operation, the gap portion 17 would separate the upper portions of each chamber 14, 16 in order to prevent the inadvertent mixture of liquids. The separation of the first bottle neck (rim or first opening 304, see FIG. 1A above) from the second bottle neck (rim or second opening 306, see FIG. 1A above) via a gap portion 17 (described above with reference to FIG. 1) that may vary between a few millimeters to 1-2 inches, via the first ridge 308 and the second ridge 310, enables a user to drink two separate liquids, without mixing the liquids.

The top portion 22 is preferably an oblique surface that can have an oblique cap 220 attached to it. The top portion 22 may be at a 30 degree angle with respect to the base portion 18. The top portion 22 may be at a 45 degree angle with respect to the base portion 18. The top portion 22 may be at any angle between 0 and 90 degrees with respect to the base portion 18.

Additionally, the annular skirt 24 may include one or more sets of first latching mechanisms 30 and/or one or more sets of second latching mechanisms 32. These latching mechanisms 30, 32 allow the cap 210 to be fixedly secured to the body 12 of the bottle 50 via a first orientation recess (not shown) and a second orientation recess (not shown) located on the body 12. The latching mechanisms 30, 32 may be spaced out as single units or may be spaced out as sets of two, three, or more. Any number of latching mechanisms may be employed to secure the cap 220 to the body 12. The latching mechanisms and the orientation recesses may be any shape or size contemplated by one skilled in the art.

Moreover, the first chamber 14 may have a different volumetric size than the second chamber 16. Furthermore, the first chamber 14 may have a different height than the second chamber 16. The widths, heights, and volumetric sizes of the first chamber 14 and the second chamber 16 may be adjusted according to design preferences and desired applications.

It will be apparent to those skilled in the art that this separation of liquids via the gap portion 17 offers a substantial advantage by providing the capability to drink more than one liquid without inadvertently mixing the liquids 11, 13. It is envisioned that the top portion 22 (the rim of the body 12) may wholly extend around the gap portion 17 or may extend partially around the gap portion 17. In other words, the outer perimeter of the gap portion 17 may have an outer wall enclosing the gap portion 17. The top portion 22 may extend wholly around the gap portion 17, the first chamber 14, and the second chamber 16 in order to better secure the cap 220.

Figure 4:
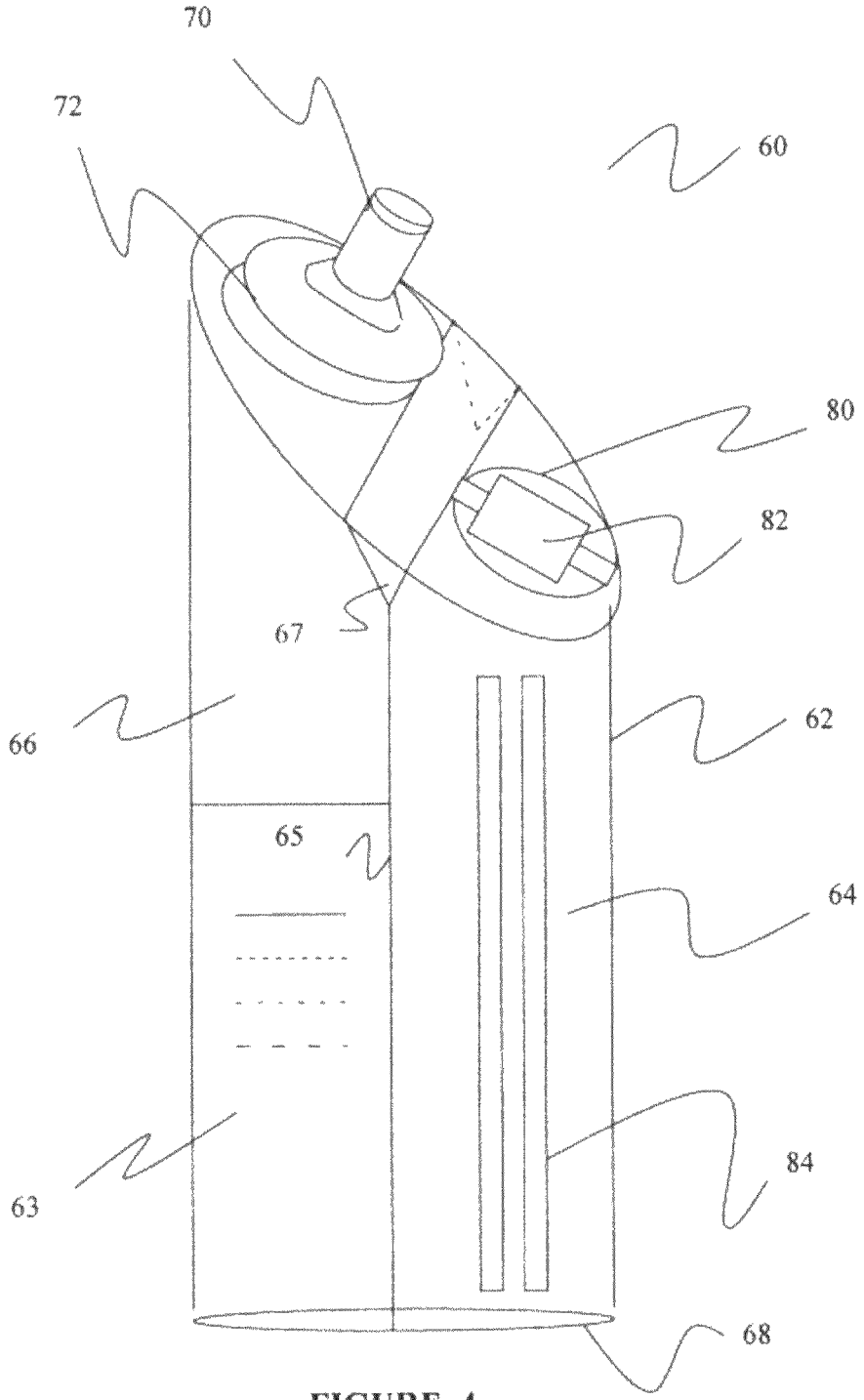
FIG. 4 is a perspective view of a dual-chambered drinking bottle, where one chamber encloses liquids and the one chamber encloses non-liquids, in accordance with the present disclosure.

With reference to FIG. 4, there is presented a perspective view of a dual-chambered drinking bottle where one chamber encloses liquids and the one chamber encloses non-liquids, in accordance with the present disclosure. The bottle 60 includes a body 62, a first chamber 64, a second chamber 66, a base portion 68, an orifice 70, a bottle neck 72, a top surface 80, an opening 82, and a storage compartment 84. The bottle 60 further includes a liquid 63, a dividing wall 65, and a gap portion 67.

In this third embodiment of the present disclosure, the dual chamber bottle 60 includes a body that is preferably formed of a hollow molded plastic material that defines two substantially cylindrical chambers 64, 66 and has a base portion 68. The bottle 60 includes a first chamber 64 for holding non-liquids in a storage compartment 84, and a second chamber 66 for holding a liquid 63. The second chamber 66 is connected to an orifice 70 via a bottle neck 72. Optionally, the orifice 70 may be connected to the second chamber 66 via a lid strap (not shown). The orifice 70 may be replaced by any type channel providing an outlet means to the mouth of a user.

The dividing wall 65 extends vertically from the base portion 68, extending through the body and ending at a height, equal to the height of the shortest chamber. The dividing wall 65 provides a means for separating the first chamber 64 from the second chamber 66. The dividing wall 65 allows the user to access the first chamber 64 having an opening 82 on the top surface 80 in order to place or remove items in the storage compartment 84.

Any types of items may be placed in the storage compartment 84. For example, a user may place one or more energy bars and/or one or more energy gels in the storage compartment 84. In addition, the storage compartment 84 may be used to store keys or other personal items that the user does not wish to handle while exercising. As a result of this embodiment, a user may be able to carry both liquid and non-liquid items, without the fear of having the liquid and non-liquid items mix together.

Figure 5:
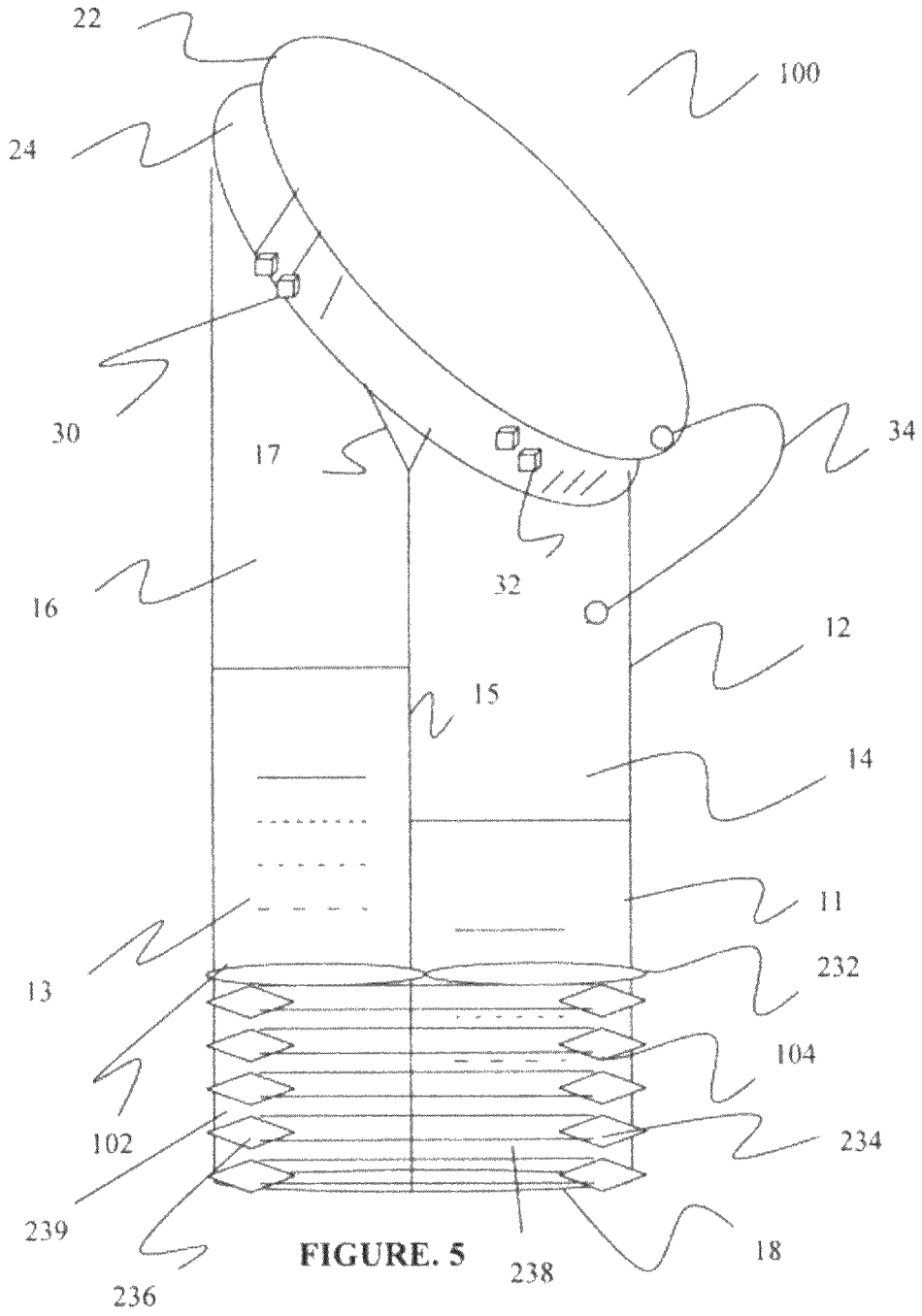
FIG. 5 is a perspective view of a dual-chambered drinking bottle including a collapsible portion located on a bottom portion of the bottle, in accordance with the present disclosure.

With reference to FIG. 5, there is presented is a perspective view of a dual-chambered drinking bottle including a collapsible portion located on a bottom portion of the bottle, in accordance with the present disclosure. The bottle 100 includes a top surface 102 and a collapsible portion 104. Additionally, the dual chamber bottle 100 includes similar elements to FIG. 1. These similar elements include a body or cylindrical enclosure 12, a first chamber 14, a second chamber 16, a base portion 18, a top portion 22, an annular skirt 24, a first latching mechanism 30, a second latching mechanism 32, a first liquid 11, a second liquid 13, a dividing wall 15, and a gap portion 17.

In FIG. 5, it is contemplated that the bottle 100 can have a collapsible portion positioned at the base portion 18. The collapsible portion may be separated by a first chamber collapsible portion 234 and a second chamber collapsible portion 236. The first chamber collapsible portion 234 and the second chamber collapsible portion 236 may have a common op surface 232. The first chamber collapsible portion 234 may include a portion of the first liquid 238 and the second chamber collapsible portion 236 may include a portion of the second liquid 239. In other words, the portion of the first liquid 238 does not mix with the portion of the second liquid 239. The first liquid 11 is the same liquid as the first portion liquid 238, whereas the second liquid 13 is the same liquid as the second portion liquid 239. The first chamber 14 and the second chamber 16 remain separated by the dividing wall 15 that extends through the first chamber collapsible portion 234 and the second chamber collapsible portion 236.

When both, the first liquid 11 and the second liquid 13 fall below a predetermined threshold, the user of the bottle 100 may exert a force on the bottom surface of the base portion 18 and collapse/bend/shrink the bottle 100 up to the top surface 232. The top surface 232 may be designed to be positioned at any height of the bottle 100. Preferably, the height of the top surface 232 is positioned at or below the midpoint height of the bottle 100. The location of the top surface 232 may also depend on the length/height of the first chamber 14 and/or the length/height of the second chamber 16 and/or the height of the body 12. The first chamber collapsible portion 234 and the second chamber collapsible portion 236 are preferably substantially flush with the side walls of body 12.

In operation, when both the first liquid 11 and the second liquid 13 have been depleted or partially consumed by a user of the bottle 100, the user may exert as force and collapse/compress the base portion 18. The portion of the first liquid 238 channels into the first liquid 11 and the portion of the second liquid 239 channels into the second liquid 13. In other words, the liquids 238, 239 in each chamber 14, 16 move in a vertical, upward direction, as the user consumes the liquids in each chamber.

This embodiment is advantageous in shrinking the dimensions of the bottle 100 when it is desired to re-store the bottle 100. As described, the compression can occur when both the first liquid 11 and the second liquid 13 have been depleted from each chamber 14, 16, respectively. In other words, the present embodiment of the disclosure contemplates dual, simultaneous compression. However, one skilled in the art can contemplate a configuration that allows singular compression of only one liquid.

Figure 6:
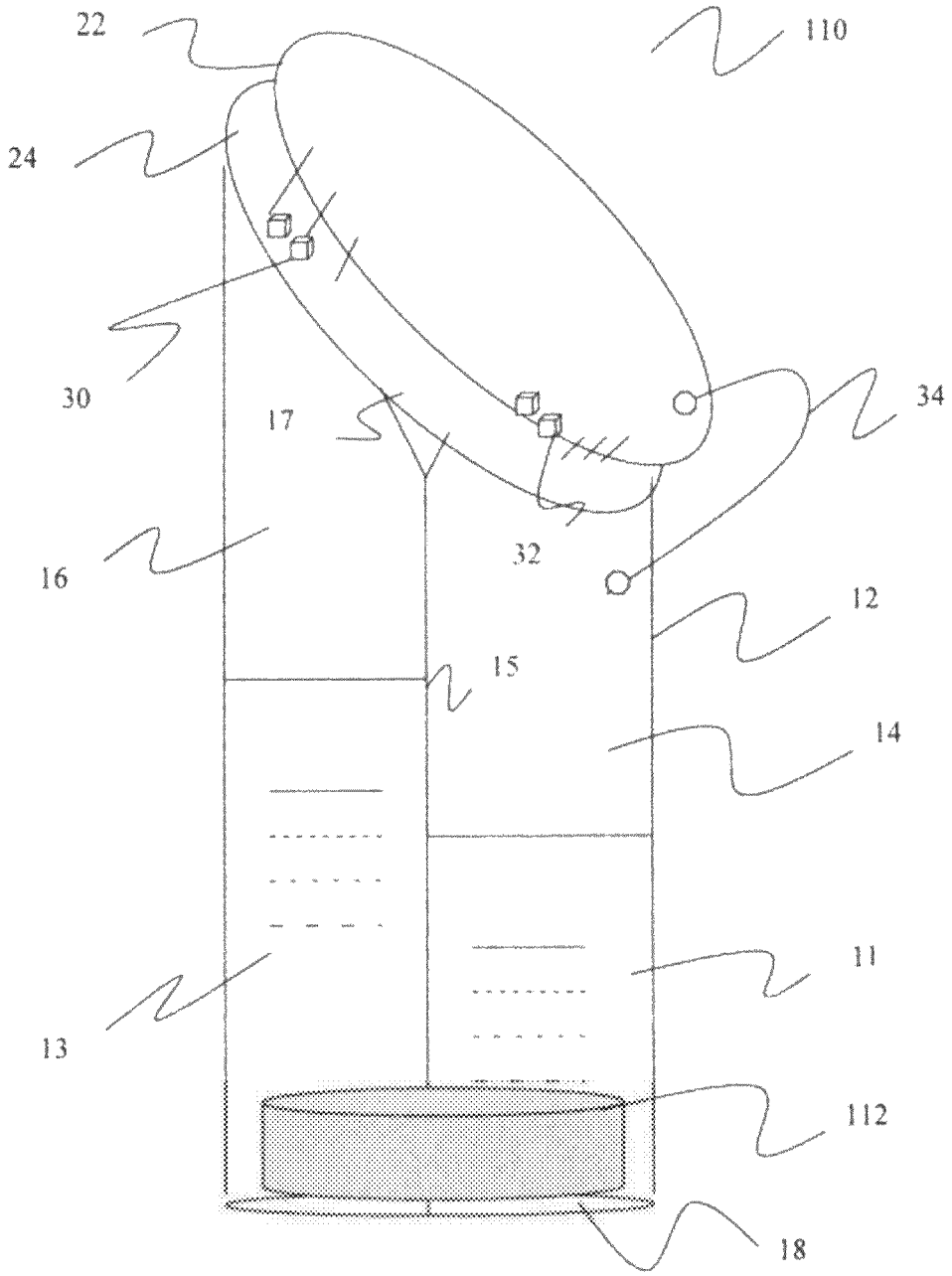
FIG. 6 is a perspective view of a dual-chambered drinking bottle including one common cooling element, in accordance with the present disclosure.

With reference to FIG. 6, there is presented a perspective view of a dual-chambered drinking bottle including one common cooling element, in accordance with the present disclosure. The bottle 110 includes a single common cooling element 112. Additionally, the dual chamber bottle 110 includes similar elements to FIG. 1. These similar elements include a body or cylindrical enclosure 12, a first chamber 14, a second chamber 16, a base portion 18, a top portion 22, an annular skirt 24, a first latching mechanism 30, a second latching mechanism 32, a first liquid 11, a second liquid 13, a dividing wall 15, and a gap portion 17.

There are certain challenges that have developed in the use of sport bottles. For example, sport bottles are typically being utilized in an outdoor environment, which makes it very difficult to keep the contents cool. In most cases the sports bottle sits out in the sun or the hot air and rapidly loses the chilling effect of the liquid, with the result that an individual then have a warm liquid. This is highly undesirable as cool liquids are significantly more refreshing. In addition, with indoor health clubs/gyms being at room temperatures and warmer than preferred for a refreshing drink, many individuals may add ice to the drink to maintain it cooler. However, this can require time and effort in fitting the ice cubes individually into the bottle fill opening, and moreover dilutes all drinks other than water as the ice melts.

In FIG. 6 of the present disclosure, it is contemplated to use a single common cooling element 112 positioned at the base portion 18 of the bottle 110. The cooling element 112 may be positioned in a separate compartment located at the bottom of both the first chamber 14 and the second chamber 16 in order to cool both liquids 11, 13 at the same time. It is noted that the cooling element 112 may be a removable cooling element that can be replaced at any time by the user of the bottle 110. The cooling element 112 may be any type of cooling element contemplated by one skilled in the art.

Figure 7:
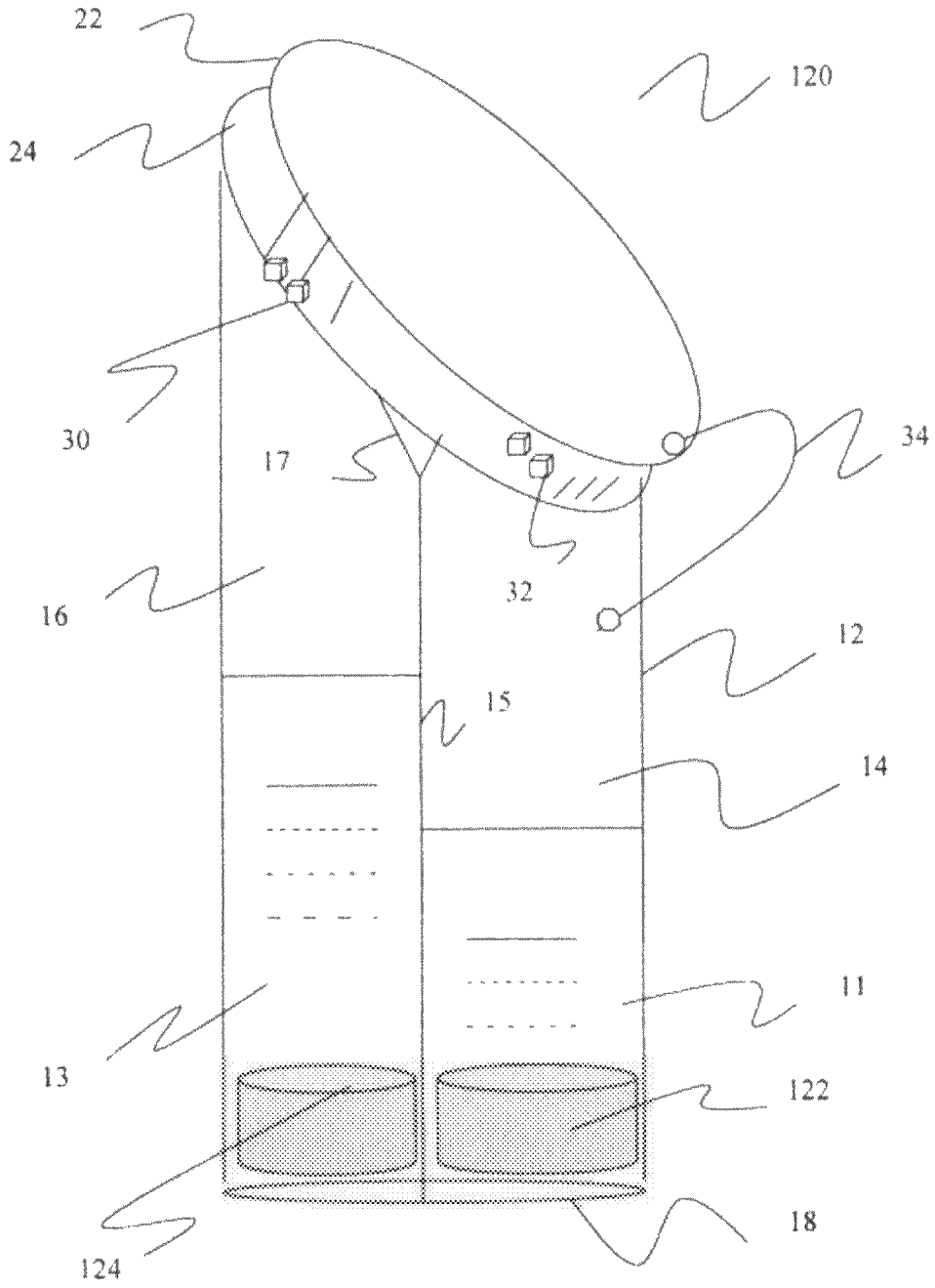
FIG. 7 is a perspective view of a dual-chambered drinking bottle including two separate cooling elements located on a bottom portion of the bottle, in accordance with the present disclosure.

With reference to FIG. 7, there is presented a perspective view of a dual-chambered drinking bottle including two separate cooling elements located on a bottom portion of the bottle, in accordance with the present disclosure. The bottle 120 includes a first cooling element 122 and a second cooling element 124. Additionally, the dual chamber bottle 120 includes similar elements to FIG. 1. These similar elements include a body or cylindrical enclosure 12, a first chamber 14, a second chamber 16, a base portion 18, a top portion 22, an annular skirt 24, a first latching mechanism 30, a second latching mechanism 32, a first liquid 11, a second liquid 13, a dividing wall 15, and a gap portion 17.

In FIG. 7 of the present disclosure, it is contemplated to use two cooling elements, a first cooling element 122 and a second cooling element 124 positioned at the base portion 18 of the bottle 120. The first cooling element 122 and the second cooling element 124 may be positioned in a separate compartment (single compartment or dual compartment) located at the bottom of the first chamber 14 and the second chamber 16, respectively, in order to cool liquid 11 with the first cooling element 122 and to cool liquid 13 with the second cooling element 124. In other words, each chamber 14, 16 may include its own separate cooling element for cooling each liquid. It is noted that the cooling elements 122, 124 may be removable cooling elements that can be replaced at any time by the user of the bottle 120. The cooling elements 122, 124 may be any type of cooling elements contemplated by one skilled in the art.

Figure 8:
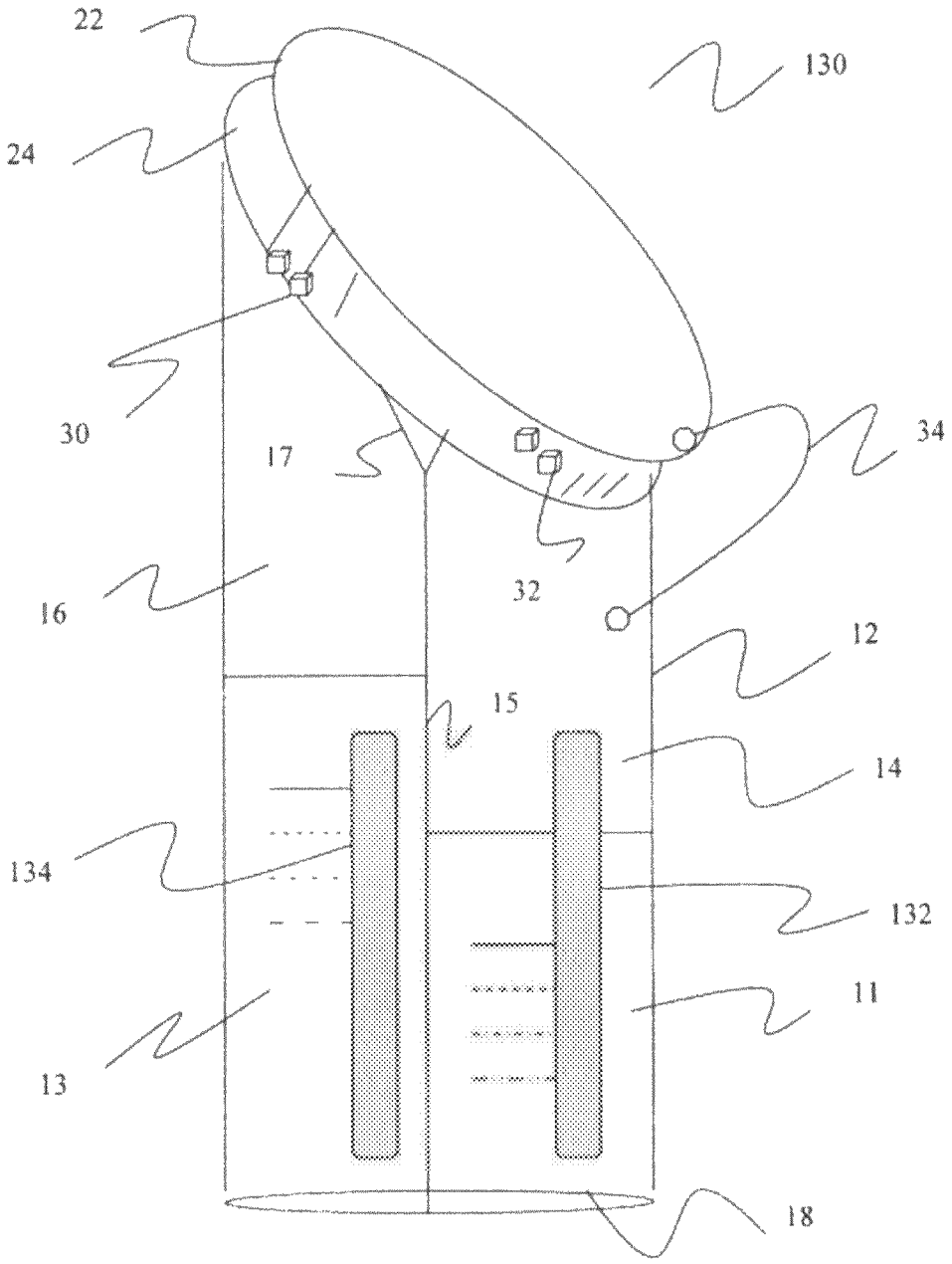
FIG. 8 is a perspective view of a dual-chambered drinking bottle including two separate cooling elements located on a side portion of the bottle, in accordance with the present disclosure.

With reference to FIG. 8, there is presented a perspective view of a dual-chambered drinking bottle including two separate cooling elements located on a side portion of the bottle, in accordance with the present disclosure. The bottle 130 includes a first cooling element 132 and a second cooling element 134. Additionally, the dual chamber bottle 130 includes similar elements to FIG. 1. These similar elements include a body or cylindrical enclosure 12, a first chamber 14, a second chamber 16, a base portion 18, a top portion 22, an annular skirt 24, a first latching mechanism 30, a second latching mechanism 32, a first liquid 11, a second liquid 13, a dividing wall 15, and a gap portion 17.

In FIG. 8 of the present disclosure, it is contemplated to use two cooling elements, a first cooling element 132 and a second cooling element 134 positioned at the side portions of the bottle 130. The first cooling element 132 and the second cooling element 134 may be positioned in a separate compartment located within the first chamber 14 and the second chamber 16, respectively, in order to cool liquid 11 with the first cooling element 132 and to cool liquid 13 with the second cooling element 134. In other words, each chamber 14, 16 may include its own separate cooling element for cooling each liquid. It is noted that the cooling elements 132, 134 may be removable (e.g., attachable or stick-on) cooling elements that can be replaced at any time by the user of the bottle 130. The cooling elements 132, 134 may be any type of cooling elements contemplated by one skilled in the art.

Moreover, while threaded connections are utilized to connect various components in the described embodiments, many other forms of connections, such as snap together connections, twist-to-lock connections and the like also can be utilized. The present disclosure may also include a twist-on or snap-on spout or nozzle, preferably of a tapered conical or substantially cylindrical shape, and internally divided. The spout or nozzle may be adapted to be sealed by an end cap, a plug, by helically twisting the "overcap" upon a "scaling rod", or by sliding upon an internal shaft affecting a seal when screwed or pushed downwards towards the bottle.

Optionally, the body of all bottles of the present disclosure may be constructed of a clear or transparent or translucent material in order to better identify the liquid contained within the first chamber and the second chamber.

Additionally, all the bottles of the present disclosure are not limited to any particular bottle shape or design. Although the bottles are described and depicted herein as being of generally cylindrical upstanding form, the configurations of the containers is a matter of design choice. The use of generally cylindrical containers is described because it gives the sports bottle a readily acceptable appearance and shape, and because generally cylindrical container shapes tend to work well if one also desires to make use of generally cylindrical, externally threaded container necks. Moreover, generally cylindrical containers tend to efficiently provide good fluid-carrying capacity at relatively low manufacturing cost. While opaque, single-thickness materials may be preferred for use, transparent or plural-layer materials may be used, if desired, to enhance visibility, to provide added insulating capability, or for other purposes.

Moreover, the first chamber and the second chamber of all the bottles of the present disclosure may be designed to contain different ratios of liquids. For example, a 50/50 ratio between the first chamber and the second chamber may be preferred. However, it is envisioned that even a 1/3 to 2/3 ratio may be practical for certain applications.

Furthermore, all the bottles of the present disclosure may include one or more caps or lids, and each of the one or more caps or lids may have a strap connected to the body. All the bottles of the present disclosure may include one or more cooling elements to cool the liquids contained within the chambers or containers. All the bottles of the present disclosure may include one or more collapsible portions to bend the chamber or containers. All the bottles of the present disclosure may be of different widths and/or heights, and each chamber of all the bottles may be of a different width and/or height. All the bottles of the present disclosure may have different caps of different shapes and/or sizes with a plurality of fastening means. All the bottles of the present disclosure may include slidable orifices moving on a slidable track in a variety of tracks. All the bottles of the present disclosure may have interchangeable parts.

Finally, all the bottles of the present disclosure may be constructed by any manufacturing means. For example, blow molding technology may be utilized. A plurality of different types of thermoplastic resins may be utilized in any type of blow molding techniques.

Accordingly, the present disclosure prevents the mixing of contents of multiple chambers during the dispensing process, thus minimizing or even eliminating the risk that two liquids are simultaneously dispensed in an inadvertent manner, by providing an oblique top surface as a cap or lid.

It will be understood that there are to be no limitations as to the dimensions and shape of the beverage bottle, including the storage compartment, or the materials from which the beverage bottle is manufactured. The bottles may be constructed to resemble any commercially available bottle for holding a liquid beverage and may be manufactured from any suitable plastic, glass or metal material. Furthermore, it should be understood that the beverage bottle of the present disclosure may be adapted to store any suitable liquid, such as, for example, water, juice, milk, carbonated sodas, protein shakes, energy drinks, beer, wine, and liquor.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

Having described the invention above, various modifications of the techniques, procedures, material and equipment will be apparent to those in the art. It is intended that all such variations within the scope and spirit of the appended claims be embraced thereby.

The foregoing examples illustrate various aspects of the invention and practice of the methods of the invention. The examples are not intended to provide an exhaustive description of the many different embodiments of the invention. Thus, although the foregoing invention has been described in some detail by way of illustration and example for purposes of clarity and understanding, those of ordinary skill in the art will realize readily that many changes and modifications can be made thereto without departing form the spirit or scope of the invention.

What is claimed is:

1. A bottle, comprising:

a body having a dividing wall therein;

a first chamber for holding a first liquid;

a second chamber for holding a second liquid;

a removable cap secured in a fixed oblique position in relation to an entire length of a base of the bottle; and a single slidable orifice configured to travel on a non-linear track adapted and dimensioned to be flush with a non-movable top surface of the removable cap.

2. The bottle according to claim 1, wherein the non-linear track includes a first non-linear segment and a second non-linear segment.

3. The bottle according to claim 1, wherein the top surface of the removable cap remains fixed with respect to movement of the single slidable orifice positioned thereon.

4. The bottle according to claim 1, wherein top surfaces of the first and second chambers are adapted and dimensioned to be constructed in an oblique direction in relation to an entire length of side surfaces of the body.

5. The bottle according to claim 1, wherein the single slidable orifice is independently adjustable with respect to the top surface of the removable cap.

6. The bottle according to claim 1, wherein the single slidable orifice locks in a first predetermined position for permitting access to the first liquid of the first chamber and locks in a second predetermined position for permitting access to the second liquid of the second chamber.

7. The bottle according to claim 1, wherein the single slidable orifice separately provides access to the first liquid of the first chamber and the second liquid of the second chamber.

8. The bottle according to claim 1, wherein the single slidable orifice is configured to vertically protrude away from the top surface of the removable cap.

9. The bottle according to claim 1, wherein the first chamber is a different volumetric size than the second chamber.

10. The bottle according to claim 1, wherein the first chamber and the second chamber are a different height.

11. A method of manufacturing a bottle, the method comprising:

forming a body having a dividing wall therein;

forming a first chamber for holding a first liquid;

forming a second chamber for holding a second liquid;

forming a removable cap secured in a fixed oblique position in relation to an entire length of a base of the bottle; and forming a single slidable orifice configured to travel on a non-linear track adapted and dimensioned to be flush with a non-movable top surface of the removable cap.

12. The method according to claim 11, wherein the non-linear track includes a first non-linear segment and a second non-linear segment.

13. The method according to claim 11, wherein the top surface of the removable cap remains fixed with respect to movement of the single slidable orifice positioned thereon.

14. The method according to claim 11, top surfaces of the first and second chambers are adapted and dimensioned to be constructed in an oblique direction in relation to an entire length of side surfaces of the body.

15. The method according to claim 11, wherein the single slidable orifice is independently adjustable with respect to the top surface of the removable cap.

16. The method according to claim 11, wherein the single slidable orifice locks in a first predetermined position for permitting access to the first liquid of the first chamber and locks in a second predetermined position for permitting access to the second liquid of the second chamber.

17. The method according to claim 11, wherein the single slidable orifice separately provides access to the first liquid of the first chamber and the second liquid of the second chamber.

18. The method according to claim 11, wherein the single slidable orifice is configured to vertically protrude away from the top surface of the removable cap.

19. The method according to claim 11, wherein the first chamber is a different volumetric size than the second chamber.

20. The method according to claim 11, wherein the first chamber and the second chamber are a different height.

* * * * *